US008952852B2

(12) United States Patent
Badaruzzaman et al.

(10) Patent No.: US 8,952,852 B2
(45) Date of Patent: Feb. 10, 2015

(54) MOBILE WIRELESS COMMUNICATIONS DEVICE INCLUDING ANTENNA ASSEMBLY HAVING SHORTED FEED POINTS AND INDUCTOR-CAPACITOR CIRCUIT AND RELATED METHODS

(75) Inventors: Firass Mirza Badaruzzaman, Oak Park, IL (US); Shing Lung Steven Yang, Rolling Meadows, IL (US); Brian Francisco Rojas, Chicago, IL (US)

(73) Assignee: BlackBerry Limited, Waterloo, Ontario (CA)

( * ) Notice: Subject to any disclaimer, the term of this patent is extended or adjusted under 35 U.S.C. 154(b) by 954 days.

(21) Appl. No.: 13/045,104

(22) Filed: Mar. 10, 2011

(65) Prior Publication Data

US 2012/0229349 A1 Sep. 13, 2012

(51) Int. Cl.

| | |
|---|---|
| ***H01Q 1/24*** | (2006.01) |
| ***H01Q 9/00*** | (2006.01) |
| ***H01Q 5/00*** | (2006.01) |
| ***H01Q 9/42*** | (2006.01) |
| ***H01Q 9/14*** | (2006.01) |

(52) U.S. Cl.

CPC ..... *H01Q 1/243* (2013.01); *H01Q 5/0058* (2013.01); *H01Q 9/42* (2013.01); *H01Q 9/14* (2013.01)

USPC ..... 343/702; 343/749

(58) Field of Classification Search

CPC ... H01Q 5/0058; H01Q 1/243; H01Q 5/0031; H01Q 9/14; H01Q 9/42

USPC ..... 343/749, 702

See application file for complete search history.

(56) References Cited

U.S. PATENT DOCUMENTS

| | | | | |
|---|---|---|---|---|
| 6,380,895 | B1 * | 4/2002 | Moren et al. | 343/700 MS |
| 6,819,287 | B2 | 11/2004 | Sullivan et al. | 343/700 MS |

(Continued)

FOREIGN PATENT DOCUMENTS

| | | | |
|---|---|---|---|
| EP | 0892459 | 1/1999 | H01Q 9/04 |
| WO | 99/03168 | 1/1999 | H01Q 1/24 |

(Continued)

OTHER PUBLICATIONS

Antenna (Radio), From Wikipedia, free encyclopedia, http://en.wikipedia.org/wiki/Antenna_(radio), downloaded Feb. 2010, pp. 1-11.

(Continued)

*Primary Examiner* — Robert Karacsony

(74) *Attorney, Agent, or Firm* — Allen, Dyer, Doppelt, Milbrath & Gilchrist, P.A.

(57) ABSTRACT

A mobile wireless communications device may include a portable housing, at least one wireless transceiver carried by the portable housing, and at least one satellite positioning signal receiver carried by the portable housing. The device may also include an antenna assembly carried by the portable housing. The antenna assembly may include a base conductor having a pair of shorted antenna feed points defined therein and coupled to the at least one wireless transceiver and the at least one satellite positioning receiver, and a first conductor aim extending outwardly from the base conductor. The antenna assembly may also include a second conductor arm also extending outwardly from the base conductor. The second conductor arm may include a proximal conductor portion adjacent the base conductor, a distal conductor portion, and an inductor-capacitor circuit coupling the proximal and distal conductor portions.

24 Claims, 6 Drawing Sheets

(56) References Cited

U.S. PATENT DOCUMENTS

| | | | | |
|---|---|---|---|---|
| 7,265,731 | B2 | 9/2007 | Vance et al. | 343/860 |
| 7,268,730 | B2 | 9/2007 | Park et al. | 343/700 MS |
| 7,405,701 | B2 | 7/2008 | Ozkar | 343/702 |
| 7,688,273 | B2 | 3/2010 | Montgomery et al. | 343/820 |
| 7,705,795 | B2 | 4/2010 | Chiang et al. | 343/768 |
| 7,777,677 | B2 | 8/2010 | Bungo et al. | 343/700 MS |
| 7,812,774 | B2 | 10/2010 | Friman et al. | 343/748 |
| 2008/0165065 | A1* | 7/2008 | Hill et al. | 343/702 |
| 2009/0207092 | A1 | 8/2009 | Nysen et al. | 343/876 |
| 2009/0289853 | A1 | 11/2009 | Tinaphong et al. | 343/700 MS |

FOREIGN PATENT DOCUMENTS

| | | | |
|---|---|---|---|
| WO | 02/078123 | 10/2002 | H01Q 1/24 |
| WO | 02/078124 | 10/2002 | H01Q 9/04 |

OTHER PUBLICATIONS

Fan et al., "A miniaturized 2.45 GHzRFID tag antenna using planar impedance transformer", PIERS Online, vol. 3, No. 7, 2007, pp. 951-954.

Kyro et al., "Dual-element antenna for DVB-H terminal", IEEE, 2008, pp. 265-368.

Li et al., "Novel multi-band broadband planar wire antennas for wireless communication handheld terminals" IEEE, 2003, pp. 44-47.

Panayi et al., "Tuning techniques for the planar inverted-F antenna", University of Glamorgan, UK, no date available, pp. 1-4.

Thaysen et al., "Mutual coupling reduction using a lumped LC circuit", Technical University of Denmark, www.dtu.dk, no date available, pp. 1-4.

* cited by examiner

MOBILE WIRELESS COMMUNICATIONS DEVICE INCLUDING ANTENNA ASSEMBLY HAVING SHORTED FEED POINTS AND INDUCTOR-CAPACITOR CIRCUIT AND RELATED METHODS

TECHNICAL FIELD

The present disclosure generally relates to the field of wireless communications systems, and, more particularly, to mobile wireless communications devices and related methods.

BACKGROUND

Mobile wireless communications systems continue to grow in popularity and have become an integral part of both personal and business communications. For example, cellular telephones allow users to place and receive voice calls almost anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for antennas.

DETAILED DESCRIPTION

Figure 1:
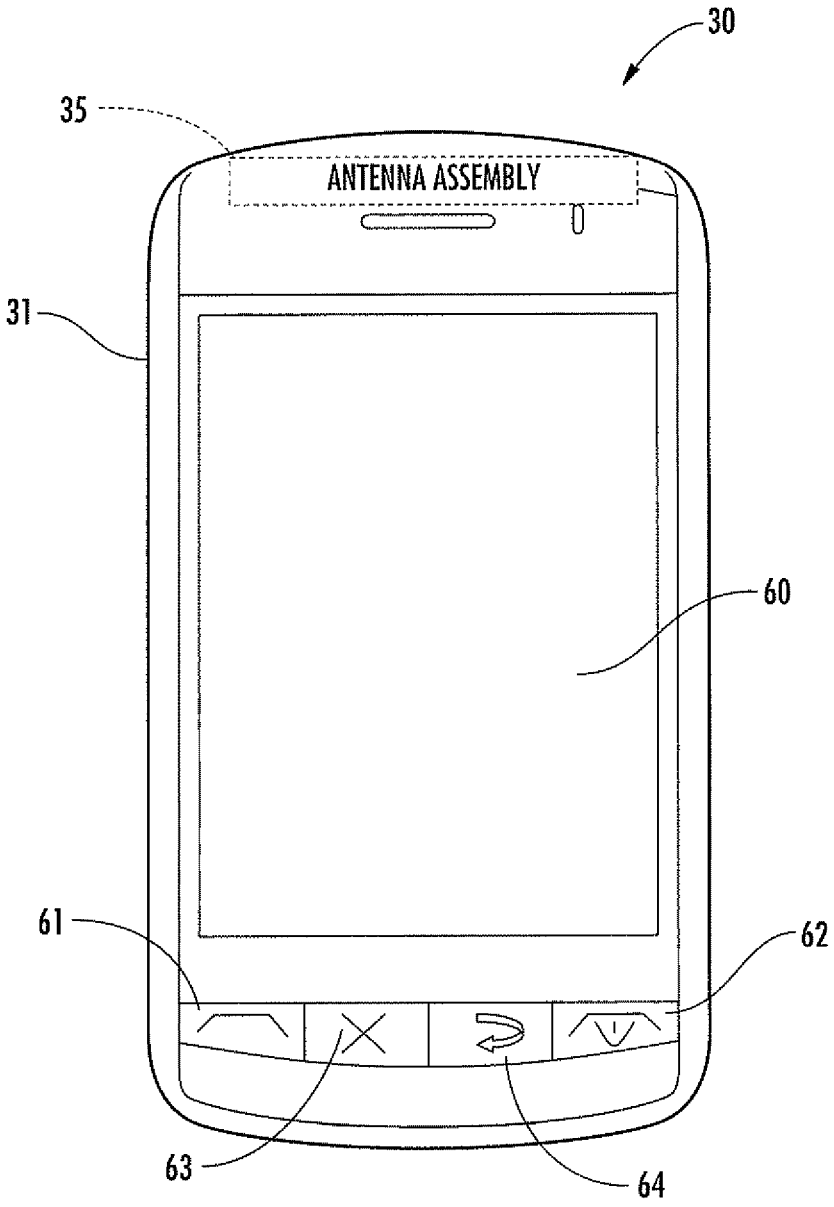
FIG. 1 is a top plan view of a mobile wireless communications device including an antenna assembly in accordance with one example embodiment.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements or steps in alternative embodiments.

In accordance with one exemplary aspect, a mobile wireless communications device may include a portable housing, at least one wireless transceiver carried by the portable housing, and at least one satellite positioning signal receiver carried by the portable housing. The mobile wireless communications device may also include an antenna assembly carried by the portable housing, for example.

The antenna assembly may include a base conductor having a pair of shorted antenna feed points defined therein and coupled to the at least one wireless transceiver and the at least one satellite positioning signal receiver. The antenna assembly may further include a first conductor arm extending outwardly from the base conductor. The antenna assembly may also include a second conductor arm also extending outwardly from the base conductor, for example. The second conductor arm may include a proximal conductor portion adjacent the base conductor, a distal conductor portion, and an inductor-capacitor circuit coupling the proximal and distal conductor portions.

The antenna assembly may include a dielectric substrate, for example. The base conductor, the first conductor arm, and the second conductor arm may be carried by the dielectric substrate. The dielectric substrate may be flexible dielectric substrate, for example.

The first conductor arm may double back toward the base conductor. The second conductor arm may double back toward the base conductor. The second conductor arm may be longer than the first conductor arm, for example.

The portable housing may have opposing upper and lower portions. The antenna assembly may be adjacent the upper portion of the portable housing, for example. The first conductor arm may extend laterally along the upper portion of the portable housing. The second conductor arm may extend laterally along the upper portion of the portable housing, for example.

The first and second conductor arms may be configured to provide frequency diversity. The first conductor arm may be configured to operate at a Personal Communications Service (PCS) band, for example. The second conductor arm may be configured to operate at an Advanced Mobile Phone System (AMPS) band. The inductor-capacitor circuit may be configured to operate at a Global Positioning System (GPS) band, for example.

A method aspect is directed to a method of making an antenna assembly for a mobile wireless communications device that may include a portable housing, at least one wireless transceiver carried by the portable housing, and at least satellite positioning antenna also carried by the portable housing. The method may include forming a base conductor to have a pair of shorted antenna feed points defined therein and to be coupled to the at least one wireless transceiver and the at least one satellite positioning signal receiver, for example. The method may also include forming a first conductor arm extending outwardly from the base conductor and forming a second conductor arm also extending outwardly from the base conductor. The second conductor arm may include a proximal conductor portion adjacent the base conductor, a distal conductor portion, and an inductor-capacitor circuit coupling the proximal and distal conductor portions, for example.

Figure 2:
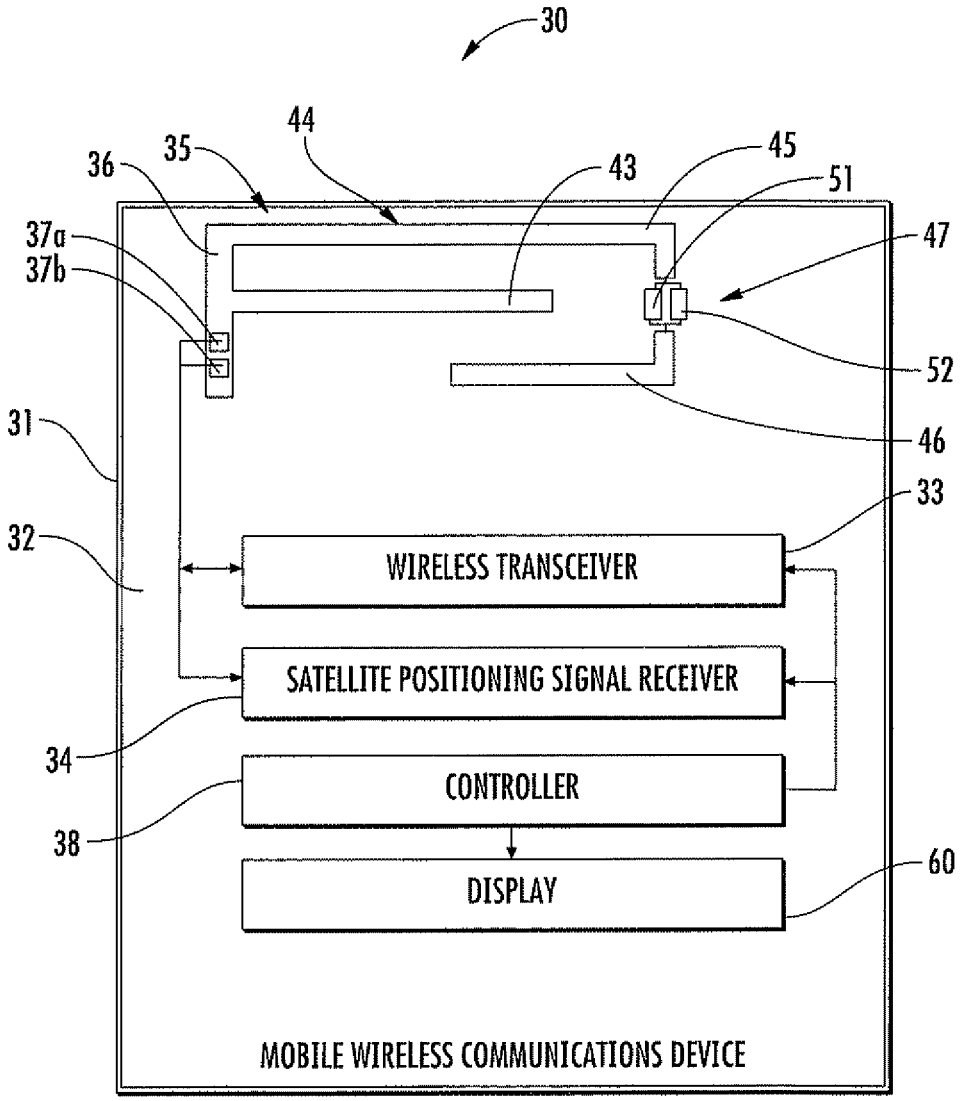
FIG. 2 is a schematic block diagram of the device of FIG. 1.

Referring initially to FIGS. 1-2, a mobile wireless communications device 30 illustratively includes a portable housing 31 and a printed circuit board (PCB) 32 carried by the portable housing. The portable housing 31 has an upper portion and a lower portion. A wireless transceiver 33 is carried by the portable housing. In some embodiments, not shown, the PCB 32 may be replaced by or used in conjunction with a metal chassis or other substrate. The PCB 32 may also include a conductive layer (not shown) defining a ground plane.

A satellite positioning signal receiver 34 is also carried by the portable housing 31. The satellite positioning signal receiver 34 may be a Global Positioning System (GPS) satellite receiver, for example.

The exemplary device 30 further illustratively includes a display 60 and a plurality of control keys including an "off hook" (i.e., initiate phone call) key 61, an "on hook" (i.e., discontinue phone call) key 62, a menu key 63, and a return or escape key 64. Operation of the various device components and input keys, etc., will be described further below with reference to FIG. 6.

The device 30 further illustratively includes a tri-band antenna assembly 35 carried adjacent the upper portion of the portable housing 31. The antenna assembly 35 is advantageously a two-arm planar inverted F-antenna (PIFA) that may be tuned to different frequency bands, for example. The antenna assembly 35 illustratively includes a base conductor 36 having a pair of shorted antenna feed points 37*a*, 37*b* defined therein. The shorted antenna feed points 37*a*, 37*b*, are coupled to the wireless transceiver 33 and the satellite positioning receiver 34.

The antenna assembly 35 also includes a first conductor arm 43 extending outwardly from the base conductor 36. The first conductor arm 43 is advantageously tuned to create a resonant frequency between 1930 MHz and 1990 MHz for example. This frequency range is advantageously in the Personal Communications Service (PCS) band receive frequency band. Of course, the first conductor arm 43 may be tuned to be resonant at other frequency ranges.

The antenna assembly 35 also includes a second conductor arm 44 also extending outwardly from the base conductor 36. The second conductor arm 44 illustratively includes a proximal conductor portion 45 adjacent the base conductor 36. The proximal conductor portion 45 is illustratively L-shaped. The proximal conductor portion 45 may be other shapes, as will be appreciated by those skilled in the art.

The second conductor arm 44 also illustratively includes a distal conductor portion 46. The distal conductor portion is also L-shaped. The distal conductor portion 46 may be other shapes, as will be appreciated by those skilled in the art.

The second conductor arm 44 is advantageously tuned to create a resonant frequency between 869 MHz and 894 MHz for example. This frequency range is advantageously in the Advanced Mobile Phone System (AMPS) receive frequency band. Of course, the second conductor arm 44 may be tuned to be resonant at other frequency ranges.

The second conductor arm 44 also includes an inductor-capacitor circuit 47 coupling the proximal and distal conductor portions 45, 46. In other words, the proximal and distal conductor portions 45, 46 are spatially separated, or have a gap therebetween. The inductor-capacitor circuit 47 bridges the gap between or couples the proximal and distal conductor portions 45, 46 so that the second conductor arm 44 has an overall J-shape. The first conductor arm 43 extends within the J-shape of the second conductor arm 44. Of course, the second conductor arm 44 may be another shape, as defined by the proximal and distal conductor portions 45, 46.

The inductor-capacitor circuit 47 includes an inductor 51 and a capacitor 52 bridging the gap between the proximal and distal conductor portions 45, 46. More than one inductor and/or capacitor 51, 52 may be used. The inductor-capacitor circuit 37 advantageously cooperates with the proximal and distal conductor portions 45, 46 to create a resonant frequency between 1570 MHz and 1580 MHz, for example. This frequency range is advantageously in the Global Positioning System (GPS) frequency band. As will be appreciated by those skilled in the art, the desired component values (i.e. the value of the inductor 51 and the capacitor 52) of the inductor-capacitor circuit 47 may be based upon a desired frequency or frequency range. In other words, the inductor-capacitor circuit 47 may be designed according to the following equation:

$$f=\frac{1}{2\Pi/(LC)}$$

where f is the desired frequency and L is the value of the inductor 51, and C is the value of the capacitor 52. To tune to a resonance in the GPS frequency band, the value of the capacitor may be between 2.6 pF and 3.6 pF, for example, and the inductor may have a value between 2.8 nH and 3.9 nH. Of course, the desired component values of the inductor-capacitor circuit 47 may be derived from simulations performing using simulation hardware and/or programs and may have other values.

A controller 38 or processor may also be carried by the PCB 32. The controller 38 may cooperate with the other components, for example, the antenna assembly 35, the satellite positioning signal receiver 34, and the wireless transceiver 33 to coordinate and control operations of the mobile wireless communications device 30. Operations may include mobile voice and data operations, including email and Internet data.

Figure 3:
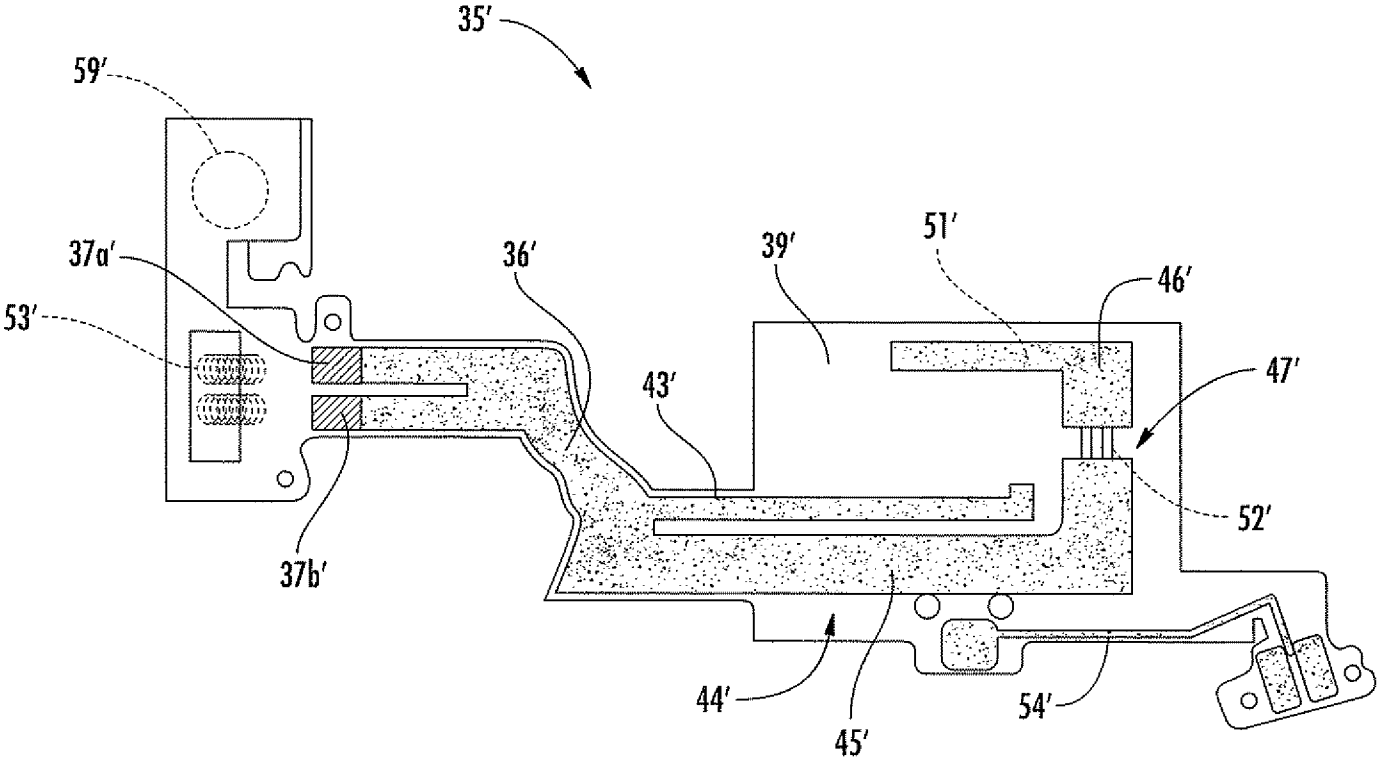
FIG. 3 is an enlarged view of an antenna assembly according to another example embodiment.

Referring now to FIG. 3, in another example embodiment, the antenna assembly 35' may be carried by a flexible substrate 39'. The flexible substrate 39' may be included with another PCB (not shown), for example, the device PCB, for carrying other components or circuitry, for example, the controller 38', the display 60', the wireless transceiver 33', and the satellite positioning signal receiver 34'. The flexible substrate 39' may advantageously allow for conforming of the antenna assembly 35' with the back of the portable housing 31'. The flexible substrate 39' may include an adhesive layer (not shown), for example, a pressure sensitive adhesive, on an underside thereof to mount with the mobile wireless communications device 30'. A copper layer (not shown) may be carried on a front side of the flexible substrate 39'.

Two place holders (one for the inductor 51' and the capacitor 52') (not shown) advantageously provide support for the inductor-capacitor circuit 47' on the flexible substrate 39'. The inductor 51' and capacitor 52' of the inductor-capacitor circuit 47' may be mounted from the underside or the backside of the flexible substrate 39' onto the copper layer on the front side of the flexible substrate.

The base conductor 36' is shaped in a meandering pattern. The meandering pattern increased conformity to a portable housing when the antenna assembly 35' is mounted thereby, for example. The base conductor 36' meanders away from the first and second conductor arms 43', 44' and has the pair of shorted antenna feed points 37*a*', 37*b*' defined in an end thereof.

Illustratively, the first conductor arm 43' extends alongside an inside of the proximal conductor portion 45' of the second conductor arm 44'. The first conductor arm 43' extends inwardly to define an L-shape. The first conductor arm 43' may extend in other directions or may extend different distances.

Additional circuitry may be carried by the flexible substrate 39'. For example, a camera flash circuit 53' may be carried by the flexible substrate 39' adjacent the shorted antenna feed points 37*a*', 37*b*'. Also, a mute circuit may 54' be carried by the flexible substrate 39' adjacent the second conductor arm 44'. A microphone 59' may also be carried by the flexible substrate 39' adjacent the shorted antenna feed points 37*a*', 37*b*'. Other circuits or devices may be carried by the flexible substrate 39'.

Figure 4:
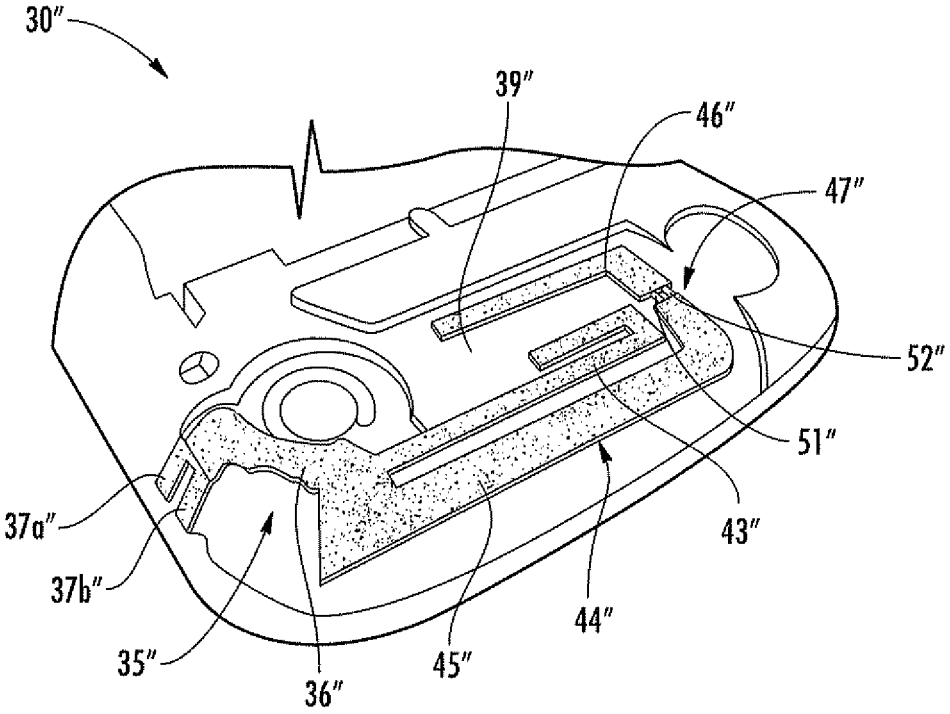
FIG. 4 is perspective view of a portion of a mobile wireless communications device including an antenna assembly according to another example embodiment.
Figure 5:
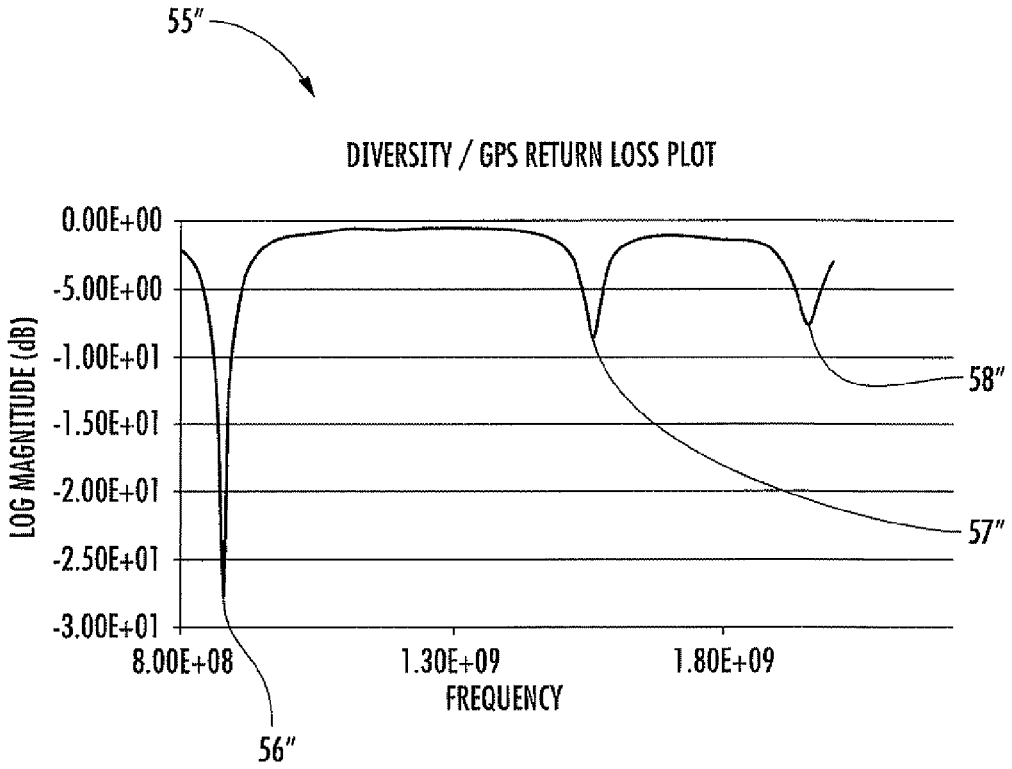
FIG. 5 is a graph of measured return loss for the mobile wireless communications device in FIG. 4.

Referring now to FIG. 4, a portion of a mobile wireless communications device 30" according to another example embodiment is illustrated. The flexible substrate 39" advantageously allows for conforming of the antenna assembly 35" with the back of the portable housing 31". The flexible substrate 39" may include an adhesive layer (not shown), for example, a pressure sensitive adhesive, on an underside thereof to mount with the mobile wireless communications device 30".

The base conductor 36" is shaped in a meandering pattern. The meandering pattern illustratively allows the antenna assembly 35" to conform with other device hardware or circuitry (i.e. detour around), for example. The base conductor 36" meanders away from the first and second conductor arms 43", 44" down to a side of the device 30" wherein the pair of shorted antenna feed points 37*a*", 37*b*" are defined in an end thereof.

The first conductor arm 43" illustratively also doubles back similar to the second conductor arm 44". In other words, the first conductor arm 43" doubles back to define a J-shape. The first conductor 43" doubles back within the J-shape defined by the second conductor arm 44". The first conductor arm 43" may be another shape, and, in some embodiments, may double back beyond the second conductor arm 44", or may not double back within the J-shape defined by the second conductor arm 44".

Figure 6:
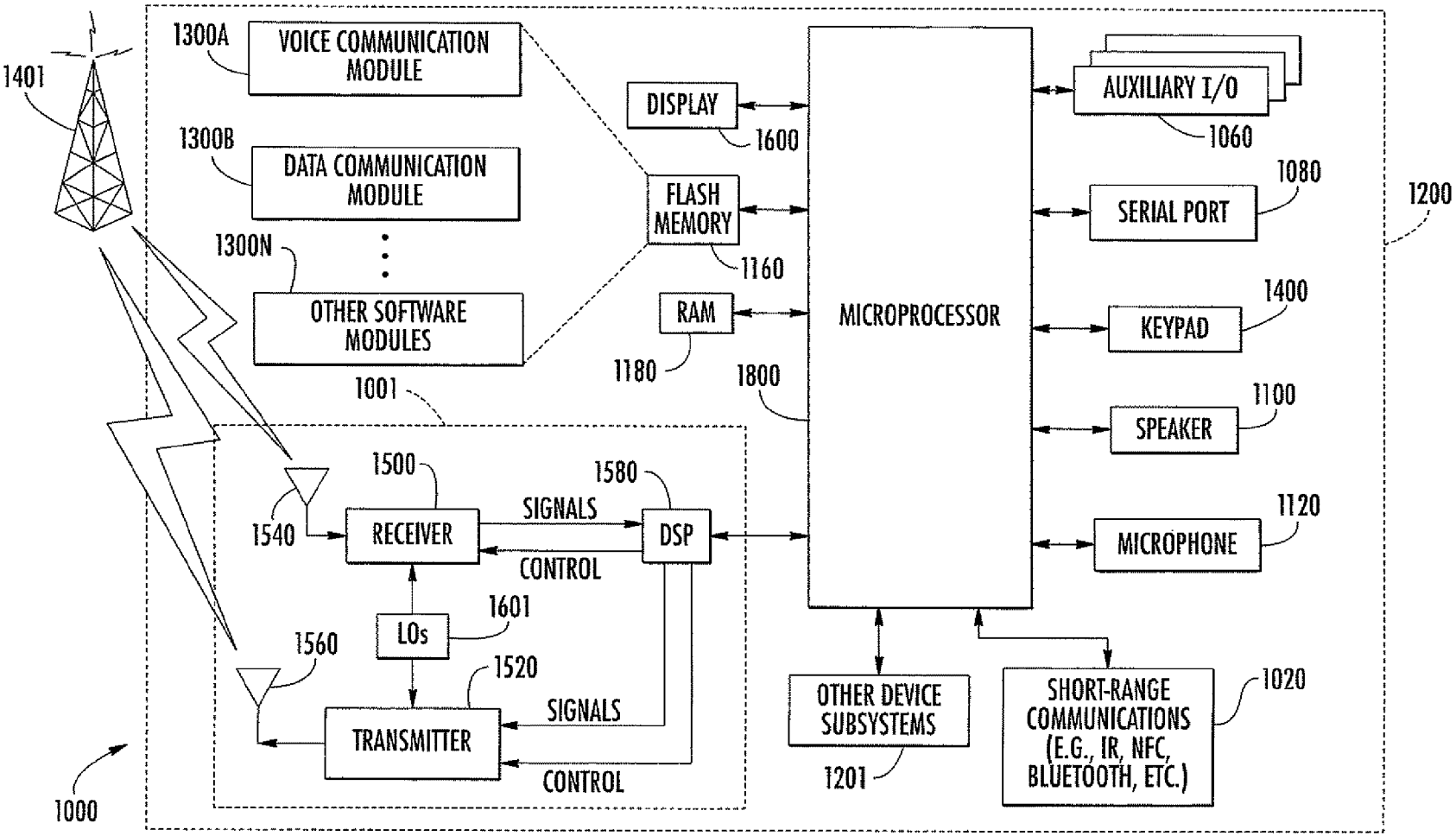
FIG. 6 is a schematic block diagram illustrating additional components that may be included in the mobile wireless communications device of FIG. 1.

Referring now to the graph 55" in FIG. 6, the measured return loss in the mobile wireless device 30" in FIG. 4 is shown. As will be appreciated by those skilled in the art, the graph illustratively includes three frequency ranges of reduced loss 56", 57", 58", that correspond to the AMPS frequency range, the GPS frequency range, and the PCS frequency range, respectively.

The tri-band functionality of the antenna assembly 35 may be particularly useful to support dual band receiving diversity and GPS receiving. Thus, the antenna assembly 35 advantageously may reduce production costs, PCB space, component count, and a number of antenna elements for supping these features as may be requested by mobile device carriers, for example.

A method aspect is directed to a method of making the antenna assembly 35. The method includes forming a base conductor 36 to have a pair of shorted antenna feed points 37*a*, 37*b*, defined therein and to be coupled to the wireless transceiver 33 and the satellite positioning signal receiver 34. The method also includes forming a first conductor arm 43 extending outwardly from the base conductor 36, and forming a second conductor arm 44 also extending outwardly from the base conductor. The second conductor arm 44 includes a proximal conductor portion 45 adjacent the base conductor 36, a distal conductor portion 46, and an inductor-capacitor circuit 47 to couple the proximal and distal conductor portions.

Example components of a mobile wireless communications device 1000 that may be used in accordance with the above-described embodiments are further described below with reference to FIG. 6. The device 1000 illustratively includes a housing 1200, a keyboard or keypad 1400 and an output device 1600. The output device shown is a display 1600, which may comprise a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

In addition to the processing device 1800, other parts of the mobile device 1000 are shown schematically in FIG. 6. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a near field communications (NFC) sensor for communicating with a NFC device or NFC tag via NFC communications.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:
- a portable housing;
- at least one wireless transceiver carried by said portable housing;
- at least one satellite positioning signal receiver carried by said portable housing; and
- an antenna assembly carried by said portable housing and comprising
  - a base conductor having a pair of shorted antenna feed points defined therein and coupled to said at least one wireless transceiver and said at least one satellite signal positioning receiver,
  - a first conductor arm extending outwardly from said base conductor,
  - a second conductor arm also extending outwardly from said base conductor and comprising
    - a proximal conductor portion adjacent said base conductor,
    - a distal conductor portion spaced apart from said proximal conductor portion, and
    - an inductor-capacitor circuit coupling said proximal and distal conductor portions.

2. The mobile wireless communications device according to claim 1, wherein said antenna assembly further comprises a dielectric substrate carrying said base conductor, said first conductor arm, and said second conductor arm.

3. The mobile wireless communications device according to claim 2, wherein said dielectric substrate comprises a flexible dielectric substrate.

4. The mobile wireless communications device according to claim 1, wherein said first conductor arm doubles back toward said base conductor.

5. The mobile wireless communications device according to claim 1, wherein said second conductor arm doubles back toward said base conductor.

6. The mobile wireless communications device according to claim 1, wherein said portable housing has opposing upper and lower portions; and wherein said antenna assembly is adjacent the upper portion of said portable housing.

7. The mobile wireless communications device according to claim 6, wherein said first conductor arm extends laterally along the upper portion of said portable housing.

8. The mobile wireless communications device according to claim 6, wherein said second conductor arm extends laterally along the upper portion of said portable housing.

9. The mobile wireless communications device according to claim 1, wherein said first and second conductor arms are configured to provide frequency diversity.

10. The mobile wireless communications device according to claim 1, wherein said first conductor arm is configured to operate at a Personal Communications Service (PCS) band.

11. The mobile wireless communications device according to claim 1, wherein said second conductor arm is configured to operate at an Advanced Mobile Phone System (AMPS) band.

12. The mobile wireless communications device according to claim 1, wherein said inductor-capacitor circuit is configured to operate at a Global Positioning System (GPS) band.

13. An antenna assembly for a mobile wireless communications device comprising a portable housing, at least one wireless transceiver carried by the portable housing, and at least one satellite positioning signal receiver also carried by the portable housing, the antenna assembly comprising:

a base conductor having a pair of shorted antenna feed points defined therein and to be coupled to the at least one wireless transceiver and the at least one satellite positioning signal receiver;

a first conductor arm extending outwardly from said base conductor;

a second conductor arm also extending outwardly from said base conductor and comprising a proximal conductor portion adjacent said base conductor, a distal conductor portion spaced apart from said proximal conductor portion, and an inductor-capacitor circuit coupling said proximal and distal conductor portions.

14. The antenna assembly according to claim 13, further comprising a dielectric substrate carrying said base conductor, said first conductor arm, and said second conductor arm.

15. The antenna assembly according to claim 14, wherein said dielectric substrate comprises a flexible dielectric substrate.

16. The antenna assembly according to claim 13, wherein said first conductor arm doubles back toward said base conductor.

17. The antenna assembly according to claim 13, wherein said second conductor arm doubles back toward said base conductor.

18. The antenna assembly according to claim 13, wherein said first conductor arm is configured to operate at a Personal Communications Service (PCS) band; wherein said second conductor arm is configured to operate at an Advanced Mobile Phone System (AMPS) band; and wherein said inductor-capacitor circuit is configured to operate at a Global Positioning System (GPS) band.

19. A method of making an antenna assembly for a mobile wireless communications device comprising a portable housing, at least one wireless transceiver carried by the portable housing, and at least one satellite positioning signal receiver also carried by the portable housing, the method comprising:

forming a base conductor to have a pair of shorted antenna feed points defined therein and to be coupled to the at least one wireless transceiver and the at least one satellite positioning signal receiver;

forming a first conductor arm extending outwardly from the base conductor; and forming a second conductor arm also extending outwardly from the base conductor and comprising a proximal conductor portion adjacent the base conductor, a distal conductor portion spaced apart from the proximal conductor portion, and an inductor-capacitor circuit coupling said proximal and distal conductor portions.

20. The method according to claim 19, further comprising mounting the base conductor, the first conductor arm, and the second conductor arm on a dielectric substrate.

21. The method according to claim 20, wherein the dielectric substrate comprises a flexible dielectric substrate.

22. The method according to claim 19, wherein forming the first conductor arm comprises forming the first conductor arm to double back toward the base conductor.

23. The method according to claim 19, wherein forming the second conductor arm comprises forming the second conductor arm to double back toward the base conductor.

24. The method according to claim 19, wherein the first conductor arm is formed to operate at a Personal Communications Service (PCS) band; wherein the second conductor arm is formed to operate at an Advanced Mobile Phone System (AMPS) band; and wherein said inductor-capacitor circuit is configured to operate at a Global Positioning System (GPS) band.

* * * * *